US005331916A

United States Patent [19]

Martin

[11] Patent Number: 5,331,916

[45] Date of Patent: Jul. 26, 1994

[54] INSERT FOR CONVERTING KAYAK TO CANOE AND MODIFIED KAYAK FOR USE THEREWITH

[76] Inventor: John Martin, P.O. Box 4829, Kanehoe, Hi. 96744

[21] Appl. No.: 30,906

[22] Filed: Mar. 15, 1993

[51] Int. Cl.[5] ..... B63B 35/71

[52] U.S. Cl. ..... 114/347; 114/363

[58] Field of Search ..... 114/343, 347, 363, 123; D12/302

[56] References Cited

U.S. PATENT DOCUMENTS

| | | | |
|---|---|---|---|
| 3,370,818 | 2/1968 | Perr | 114/343 |
| 4,068,611 | 1/1978 | Leather | 114/363 |
| 4,074,793 | 2/1978 | Yuter | 186/38 |
| 4,229,850 | 10/1980 | Arcouette | 114/347 |
| 4,838,196 | 6/1989 | Ingram | 114/347 |
| 5,042,416 | 8/1991 | Arcouette | 114/347 |
| 5,189,974 | 3/1993 | Masters | 114/347 |

*Primary Examiner*—Edwin L. Swinehart

*Attorney, Agent, or Firm*—Donald A. Streck

[57] ABSTRACT

A kayak which is convertible into a canoe. There is a kayak body having a well into which a paddler's derriere fits during use. There is also an insert having a bottom surface which is a mating fit to the well and a top surface upon which a paddler sits at a position higher than a bottom surface of the well. Preferably, there is also provision for releasably attaching an outrigger to the kayak body when the kayak is operating as a canoe.

3 Claims, 3 Drawing Sheets

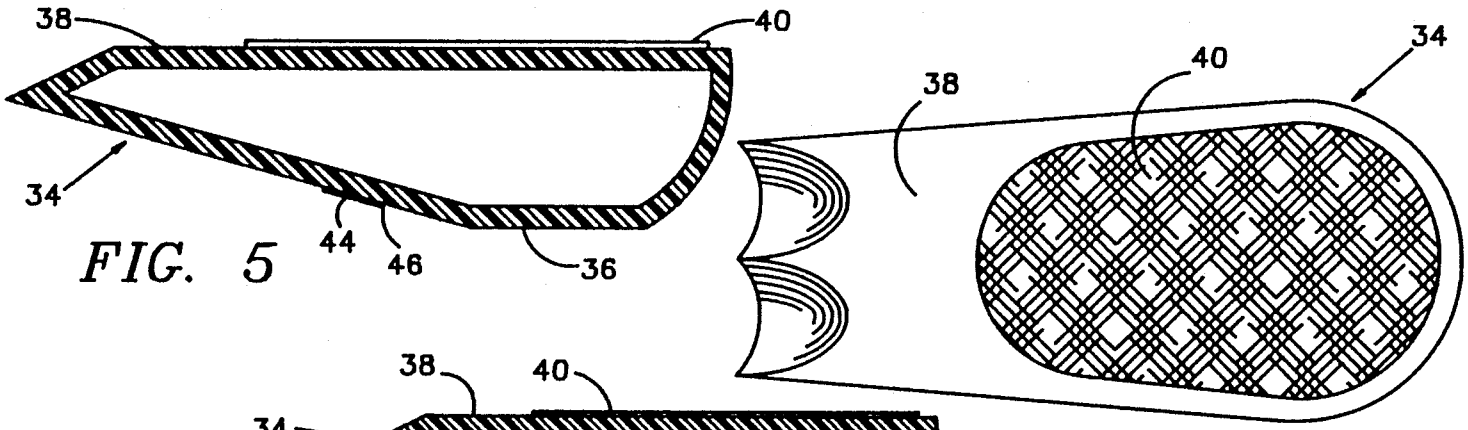
FIG. 5
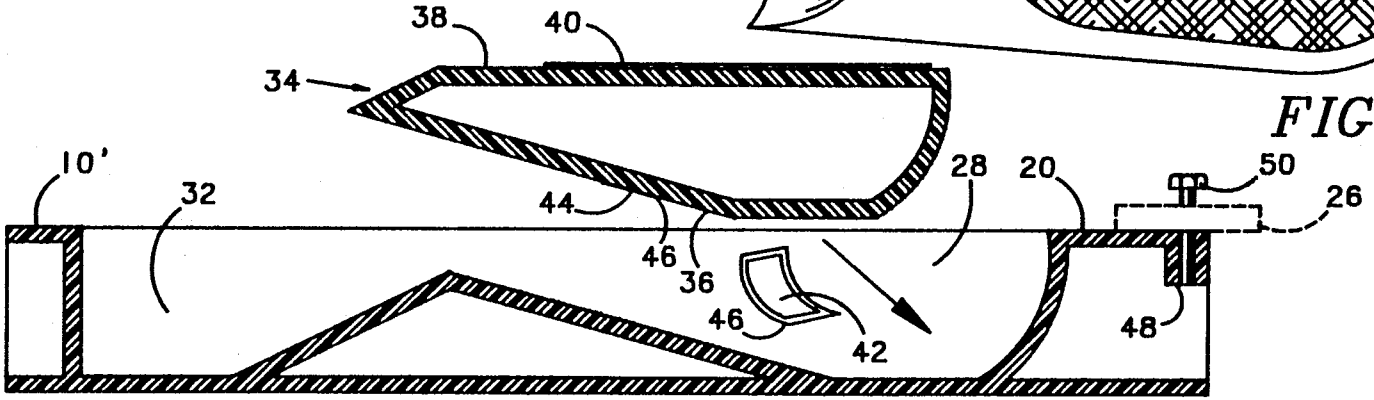
FIG. 6
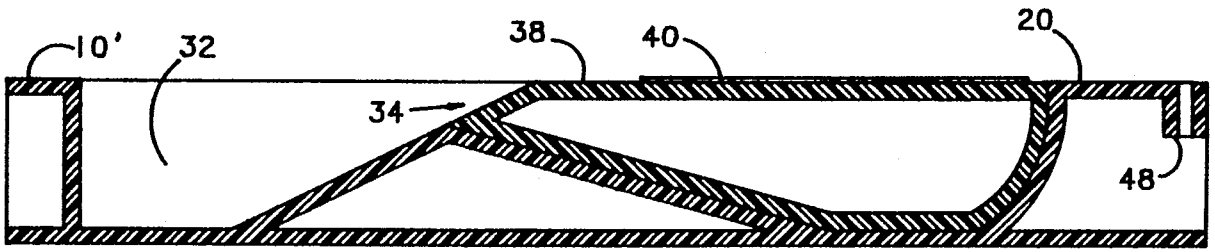
FIG. 7
FIG. 8

INSERT FOR CONVERTING KAYAK TO CANOE AND MODIFIED KAYAK FOR USE THEREWITH

BACKGROUND OF THE INVENTION

This invention relates to ocean-going canoes and kayaks and, more particularly, to apparatus for converting a kayak having a well into which a paddler's derriere fits during use into a canoe comprising, an insert having a bottom surface which is a mating fit to the well and a top surface upon which a paddler sits at a position higher than a bottom surface of the well; an outrigger; and, attachment means carried by the kayak for releasably attaching the outrigger to the kayak.

Ocean-going canoes and kayaks differ from the canoes and kayaks used in lakes and streams. They are typically longer and of considerably narrower beam. As depicted in FIG. 1, a prior art ocean-going kayak 10 is most closely akin to the dug-out canoes used by natives on the rivers of Africa and South America. Because of the extremely narrow beam, the paddler 12 is seated virtually on the on the bottom 14 of the kayak 10 so as to keep his/her center of gravity as low as possible. Typically, a two-bladed paddle is employed with a blade on each end so that the kayak 10 can roll somewhat with the stroking action of the paddler while obtaining a righting rotating reaction from the paddle blades alternately pressing down and backwards in the water. This is as compared, for example, to the Eskimo type of kayak also used by white water kayaker wherein the boat is larger and has much higher gunwales such that the kayak can actually roll over and be righted again by the paddler. If the ocean-going kayak 10 of FIG. 1 rolls over, the paddler 12 is in the water and there is no chance whatsoever that the kayak 10 will simply right itself with the paddler 12 still in place. Because of its extreme length and to allow the paddler 12 to concentrate on paddling for power and not for steering, the kayak 10 has a rudder 16 that is operated by the paddler 12 with foot peddles (not shown).

As depicted in FIG. 2, a prior art ocean-going canoe 18 is also closely akin to the dug-out canoes used by natives on the rivers of Africa and South America as compared with the canoes of Native North Americans. Typically, a one-bladed, so-called canoe paddle is employed having a blade on only one end. So that the paddler 12 can use his/her upper body more in the paddling operation, the paddler 12 sits on or close to the top surface 20 of the canoe 18. This places the paddler's center of gravity too high for stability and the one-bladed paddle cannot be used to impart righting motion to the canoe 18; so, without something more, the canoe 18 will roll over and capsize. That something more is a single or double outrigger 22 comprised of one or two amas 24 attached to the end(s) of a pair of yakus 26. Older canoes and multi-paddler canoes had the yakus 26 lashed to the canoe; but, modern ocean-going canoes often have the yakus 26 bolted to the canoe with rust-proof bolts so that the yakus 26 can be removed for transporting the canoe from place to place easily on car-top, trailer, or the like. Also, like the kayak 10 and for the same reasons, a modern canoe 18 has a rudder 14 that is operated by the paddler 12 with foot-peddles (not shown).

A problem with ocean-going canoes and kayaks is that the users thereof are sometimes faced with conditions where they wish they had the other kind of equipment. A kayak is more unstable in the water; but, faster and easier to paddle with its two-bladed paddle. Thus, for racing or exercise, it is often preferred. On the other hand, the canoe with its outrigger(s) is more stable and therefore more suitable for beginners and users who do not want to have to constantly pay attention to what they are doing to avoid capsizing such as when the boat is used for fishing. If a group goes boating together, there may be some users with a preference for a canoe and others with a preference for a kayak.

One solution would be to have one of each and take them both with you whenever you went boating. Most often, this is not practical because of cost considerations and space considerations relative to transporting multiple boats.

Wherefore, it is an object of this invention to provide a way in which a kayak can be quickly and easily converted into a canoe.

It is another object of this invention to provide a modified kayak that is capable of being converted into a canoe.

It is still another object of this invention to provide an insert which can be used to change the modified kayak into a canoe.

Other objects and benefits of the invention will become apparent from the detailed description which follows hereinafter when taken in conjunction with the drawing figures which accompany it.

SUMMARY

The foregoing objects have been achieved in a kayak having a well into which a paddler's derriere fits during use by the improvement of the present invention which allows the kayak to be operated as a canoe comprising, an insert having a bottom surface which is a mating fit to the well and a top surface upon which a paddler sits at a position higher than a bottom surface of the well.

In the preferred embodiment, cooperating means are carried by mating portions of the bottom surface of the insert and the well for releasably holding the insert in the well. The preferred cooperating means comprises one half of touch fastener material carried by the bottom surface of the insert and a second half of the touch fastener material carried by an inner surface of the well. Preferably, one half of the touch fastener material is disposed in indentations in the bottom surface of the insert and the other half of the touch fastener material is disposed in indentations in the inner surface of the well whereby the cooperating means does not interfere with the insert fully mating with the well.

Also, in the preferred embodiment includes attachment means carried by the kayak for releasably attaching an outrigger to the kayak when it is operating as a canoe.

DESCRIPTION OF THE DRAWINGS

FIG. 5 is an enlarged, simplified, cutaway side view through the conversion insert of the present invention.

FIG. 6 is an enlarged plan view of the conversion insert of the present invention.

FIG. 7 is an enlarged, simplified, cutaway side view through a kayak according to the present invention in the area where the paddler sits showing the conversion insert of the present invention in the process of being inserted to convert the kayak to a canoe.

FIG. 8 is an enlarged, simplified, cutaway side view through a kayak according to the present invention in the area where the paddler sits showing the conversion insert of the present invention fully inserted whereby the kayak has been converted to a canoe.

DESCRIPTION OF THE PREFERRED EMBODIMENT

Figure 1:
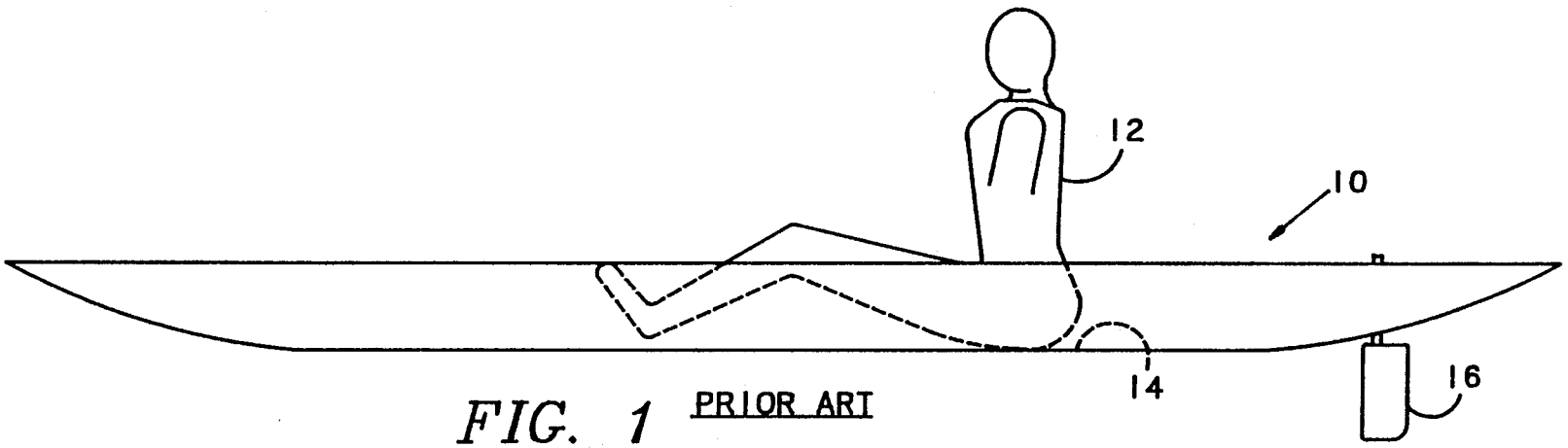
FIG. 1 PRIOR ART
FIG. 1 is a simplified side view of a prior art ocean-going kayak.
Figure 2:
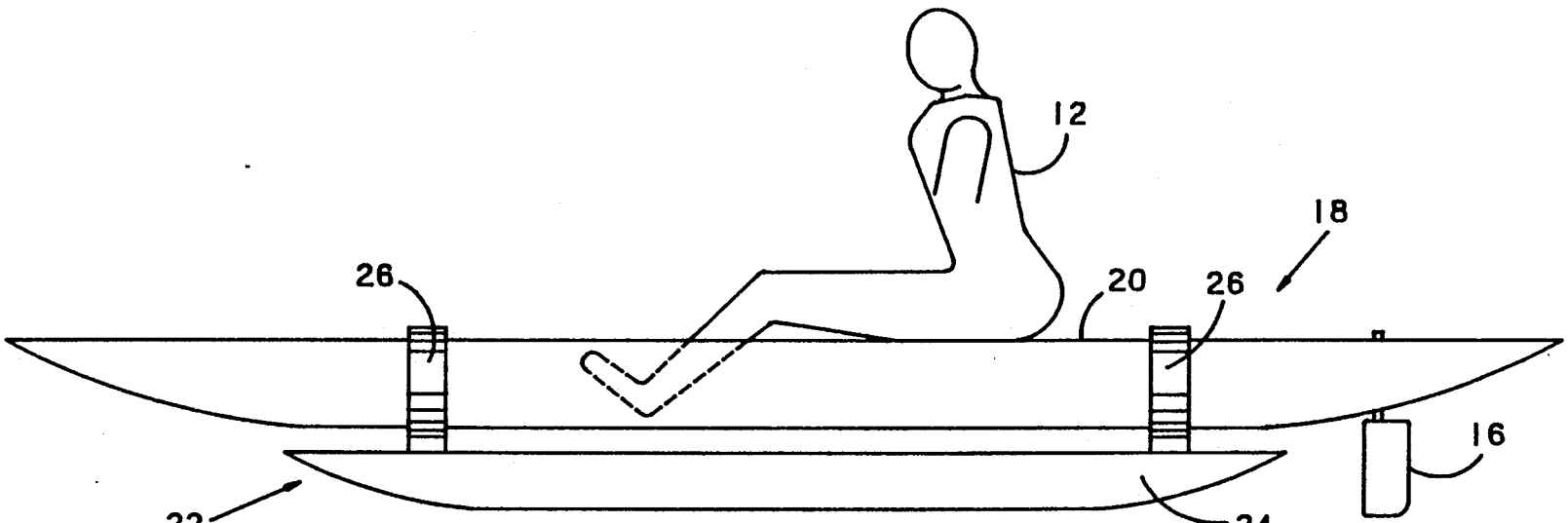
FIG. 2 PRIOR ART
FIG. 2 is a simplified side view of a prior art ocean-going canoe.
Figure 3:
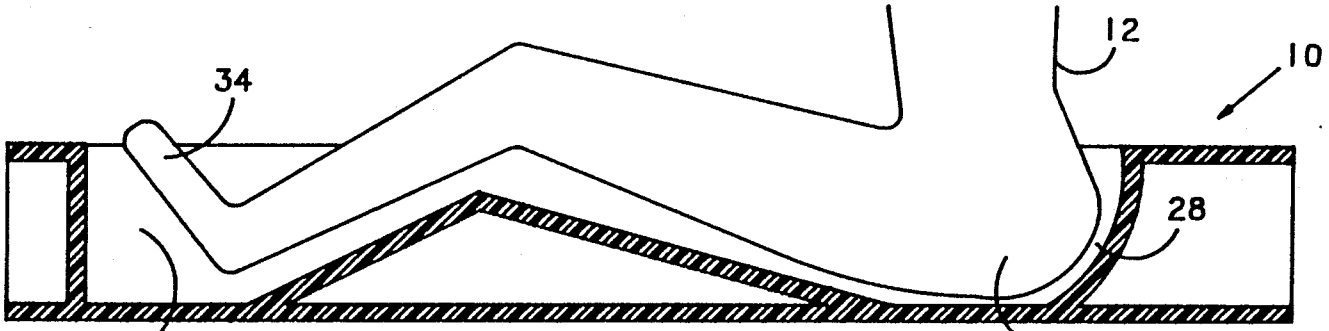
FIG. 3 PRIOR ART
FIG. 3 is an enlarged, simplified, cutaway side view through the kayak of FIG. 1 in the area where the paddler sits.

As depicted in FIG. 3, the typical prior art ocean-going kayak 10 has a well 28 formed therein into which the paddler's derriere 30 is placed. Typically, the well 28 is curved to fit and hug the paddler's derriere 30 to prevent slipping and the problems associated therewith. There is also a second well 32 (or pair of wells) into which the paddler's feet 34 are placed to actuate the steering peddles (not shown). The well 28 and the well(s) 32 may be connected or may be separate depending on the design and builder of the kayak 10. This is not important to the present invention as the insert of the present invention to be described shortly can be adapted to either approach.

Figure 4:
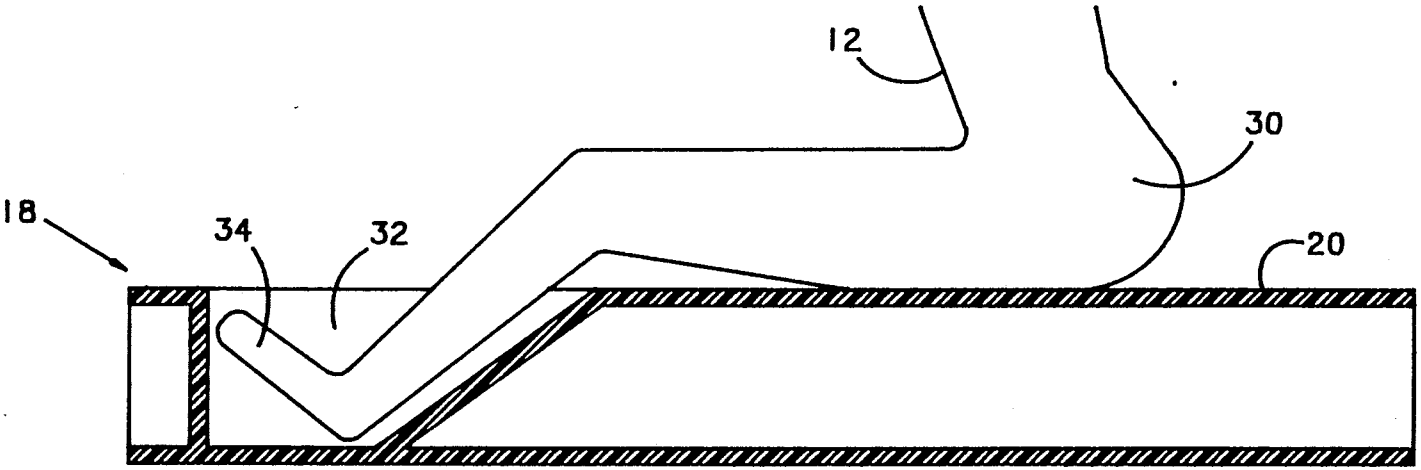
FIG. 4 PRIOR ART
FIG. 4 is an enlarged, simplified, cutaway side view through the canoe of FIG. 2 in the area where the paddler sits.

By contrast, the ocean-going canoe 18 of FIG. 4 has only the foot well(s) 32 with the paddler's derriere 30 resting on the top surface 20 as mentioned earlier.

As depicted in FIGS. 5–8, the objects of the present invention are achieved by providing an insert 34 having a bottom surface 36 shaped to be a snug fit into the well 28. With the insert 34 inserted into the well 28 as depicted in FIG. 8, the top surface 38 of the insert 34 provides an extension of the top surface 20 of the kayak behind the well 28. Preferably, the top surface 38 is shaped as a seat for the paddler's derriere 30 and, additionally, is covered with a cushioned, non-slip material 40 such as a dense foam. The insert 34 itself can be made of a plastic such as polyethylene if the quantities are such as to justify the cost of a mold. In smaller quantities, the insert 34 can be made of fiberglass formed in a mold in the manner most common for making the kayaks themselves. The cushioned, non-slip material 40 is most conveniently attached to the top surface 38 of the insert 34 with an adhesive between the two surfaces facing surfaces thereof.

Since the insert 34 is made with its bottom surface 36 a mating shape to the well 28, it is most convenient and therefore preferred to secure the insert 34 into the well 28 employing a touch fastener material such as that sold under the tradename Velcro. One half 42 of the touch fastener material (preferably the loop portion which is easier to sit upon) is adhesively fastened to the inside of the well 28 and the other half 44 of the touch fastener material (preferably the hook portion) is adhesively fastened to the bottom surface 36 of the insert 34. For an even better mating of the insert 34 into the well 28 in the presence of the touch fastener material, it is preferred that indentations 46 be provided in the surfaces of the inside of the well 28 and the bottom surface 36 of the insert 34 into which the respective portions 42, 44 of the touch fastener material are inserted so that the touch fastener material does not project above the associated surfaces and form lumps between the mating surfaces.

In addition to having the insert 34, a kayak 10' must be modified as depicted ghosted in FIG. 7 to provide a place where the yakus 26 can be attached when the kayak 10' is being used as a canoe. One way this can be accomplished is to provide sealed sockets 48 into which bolts 50 can be threaded to removably attach the yakus 26.

Wherefore, having thus described the present invention, what is claimed is:

1. A kayak having a well in an upper deck into which a paddler's derriere fits during use which is convertible into an outrigger canoe where a paddler sits on the upper deck and requiring an outrigger for stability comprising:

a) a kayak body having an upper deck containing a well with a bottom below said upper deck into which a paddler's derriere fits during use of the kayak as a kayak;

b) a removable insert having a bottom surface which is a mating fit to said well and a top surface flush with said upper deck upon which a paddler sits during use of the kayak as an outrigger canoe;

c) an outrigger comprising at least one float attached at the ends of a pair of arms extending laterally outward from said kayak body; and, d) attachment means carried by said kayak body for releasably attaching said outrigger to said kayak body when the kayak is being used as an outrigger canoe.

2. Apparatus for converting a kayak having a seat-shaped well in an upper deck thereof into which a paddler's derriere fits during use into an outrigger canoe where a paddler sits on the upper deck and requiring an outrigger for stability comprising:

a) a removable insert having a bottom surface which is a mating fit to the well and a top surface flush with the upper deck upon which a paddler sits during use of the kayak as an outrigger canoe;

b) an outrigger comprising at least one float attached at the ends of a pair of arms extending laterally outward from the kayak; and, c) attachment means carried by the kayak for releasably attaching said outrigger to the kayak.

3. A small boat which is convertible between a kayak having a well in an upper deck into which a paddler's derriere fits during use and an outrigger canoe where a paddler sits on the upper deck and requiring an outrigger for stability comprising:

a) a boat body having an upper deck containing a well with a bottom below said upper deck into which a paddler's derriere fits during use of said boat body as a kayak;

b) a removable insert having a bottom surface which is a mating fit to said well and a top surface flush with said upper deck upon which a paddler sits during use of said boat body as an outrigger canoe;

c) an outrigger comprising at least one float attached at the ends of a pair of arms extending laterally outward from said boat body; and, d) attachment means carried by said boat body for releasably attaching said outrigger to said boat body during use of said boat body as an outrigger canoe.

* * * * *